United States Patent [19]

Wall

[11] 4,367,772

[45] Jan. 11, 1983

[54] NOZZLE ASSEMBLY FOR A WEAVING MACHINE

[75] Inventor: Erich Wall, Brutten, Switzerland

[73] Assignee: Sulzer Brothers Limited, Winterthur, Switzerland

[21] Appl. No.: 168,522

[22] Filed: Jul. 14, 1980

[30] Foreign Application Priority Data

Aug. 8, 1979 [EP] European Pat. Off. ..... 79 102849.1

[51] Int. Cl.[3] ..... D03D 47/28

[52] U.S. Cl. ..... 139/435

[58] Field of Search ..... 139/435; 226/97

[56] References Cited

U.S. PATENT DOCUMENTS

| | | | |
|---|---|---|---|
| 3,180,368 | 4/1965 | Kobayashi | 139/435 |
| 4,133,353 | 1/1979 | Larmit | 139/435 |
| 4,183,382 | 1/1980 | Scheffel | 139/435 |

FOREIGN PATENT DOCUMENTS

| | | | |
|---|---|---|---|
| 610366 | 4/1979 | Switzerland | 139/435 |
| 48005 | 5/1980 | U.S.S.R. | 139/435 |

OTHER PUBLICATIONS

A Study on Air-Jet Looms by Uno et al., (p. 28 only), Journal of the Textile Machinery Society of Japan, Jul. 1961.

*Primary Examiner*—Henry Jaudon

*Attorney, Agent, or Firm*—Kenyon & Kenyon

[57] ABSTRACT

The nozzle assembly is provided for an air jet loom and includes a guide tube which is displaceable in the direction of the flowing air on the outflow tube of the nozzle. The guide tube allows the gap between the nozzle and the following nozzle or the shed to be adjusted to an optimum value, for example, during a weaving operation. The guide tube allows the weft yarn to be held in the picking line while reducing the tendency of the yarn to be deflected into the surrounding environment.

14 Claims, 7 Drawing Figures

NOZZLE ASSEMBLY FOR A WEAVING MACHINE

This invention relates to a nozzle assembly for a weaving machine. More particularly, this invention relates to a weft yarn insertion nozzle assembly for a weaving machine.

As is known, various types of weaving machines have been constructed with weft insertion nozzle assemblies of a jet type, for example, an air jet type. In such cases, the nozzle assemblies usually have an outflow channel for the weft thread to be inserted into a shed. In one known assembly, for example, as described in U.S. Pat. No. 4,133,353, the insertion nozzle has a fixed outflow channel which is directed toward the shed of the weaving machine or toward a following insertion nozzle. However, in this construction, a more or less large constant clearance or gap exists between the free end of the outflow channel of the insertion nozzle and the shed, or the following nozzle. Thus, air coming from the nozzle can pass out into the surrounding environment. As a result, the weft thread which is to be inserted into the shed can be easily deflected from the proper insertion path the hurled through the gap into the surrounding environment. This may occur especially when threading a new weft thread into the shed, for example after rupture of a weft thread. Such deflections of the weft thread are disturbing to the operation of the weaving machine, for example causing down-time and need for re-threading.

Accordingly, it is an object of the invention to provide an improved nozzle assembly for inserting weft threads into a weaving machine.

It is another object of the invention to provide a nozzle assembly for reliably inserting weft threads into a shed of a weaving machine.

It is another object of the invention to reduce mispicking of a weft thread into a weaving machine of a jet-type.

Briefly, the invention provides a yarn insertion nozzle assembly for a weaving machine which is comprised of at least one insertion nozzle having an outflow channel for directing a yarn in a given flow direction and a guide channel following the outflow channel which is movable in the flow direction of the yarn to guide the yarn. This construction limits the free space between the outflow channel of the nozzle and the shed, or a further nozzle assembly. To this end, the free space may be eliminated altogether or may be limited to a relatively samll gap. In practice, the guide channel is adjusted relative to the outflow channel to obtain an optimum position for the weaving operation being conducted. Generally, at the optimum position, the gap between the outflow channel of the nozzle and the shed, or after-connected nozzle assembly, is relatively small so that only a limited amount of air can flow off into the surrounding environment. In this way, the weft thread has little tendency to deviate from the picking line or to be deflected into the surrounding environment.

In one embodiment, the guide channel is in the form of a tube which is slidably mounted on the outflow channel for a linear back-and-forth motion. In another embodiment, the guide channel can be threaded onto the outflow channel.

The cross-sectional area of the guide channel is made substantially larger, for example from 4 to 8 times larger than the cross-sectional area of the outflow channel.

However, in some embodiments, the cross-sectional area of the guide channel may be equal to the cross-sectional area of the outflow channel. Also, in another embodiment, the free end of the guide channel may be tapered outwardly relative to the outflow channel.

These and other objects and advantages of the invention will become more apparent from the following detailed description taken in conjunction with the accompanying drawings wherein.

Figures 1, 1A, 1B, 2, 3, 4:
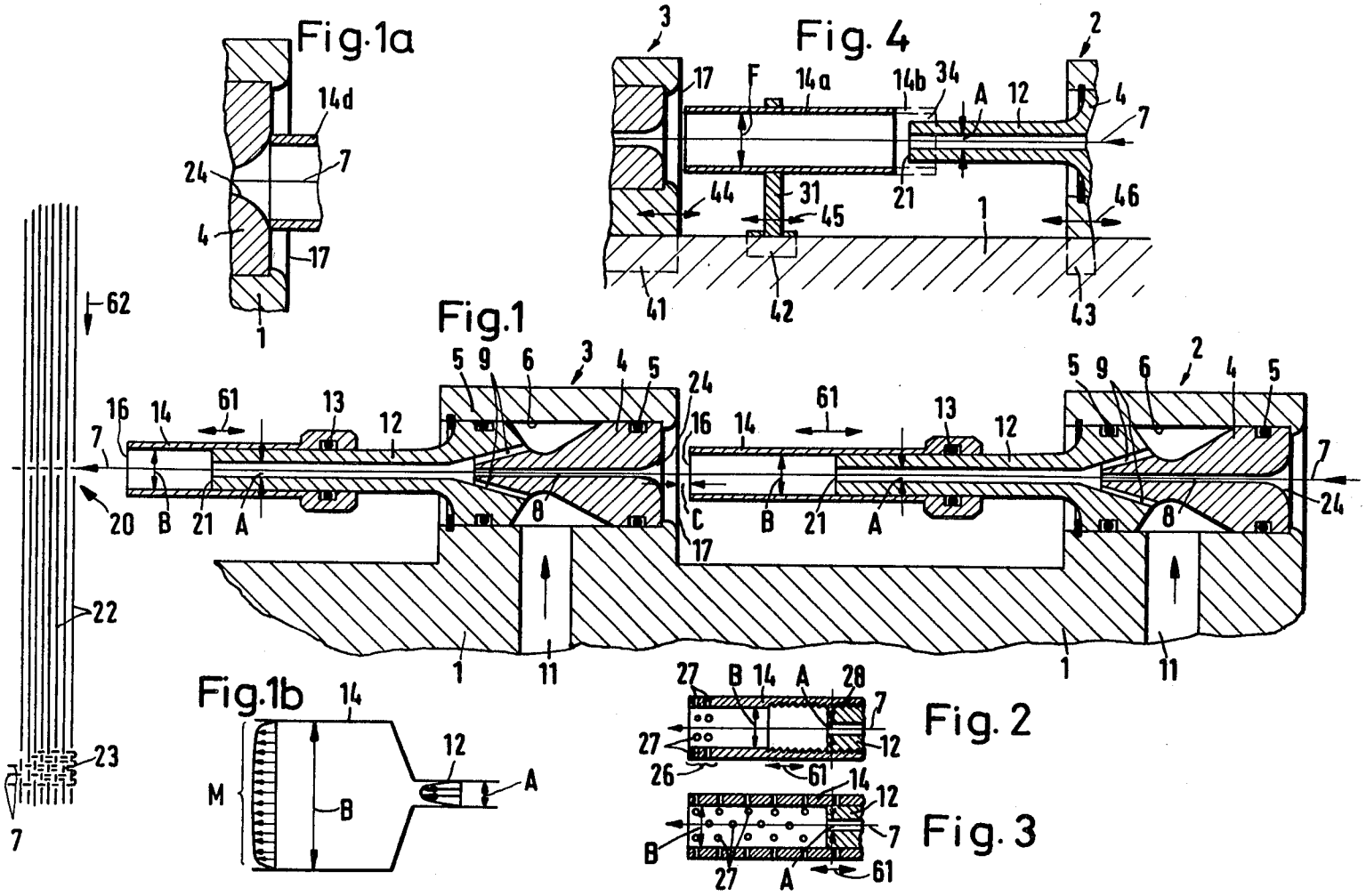
FIG. 1 illustrates a cross-sectional view through a nozzle assembly constructed in accordance with the invention.
FIG. 1A illustrates a modified relationship between a guide channel and a following insertion nozzle of the assembly of FIG. 1.
Figure 5:
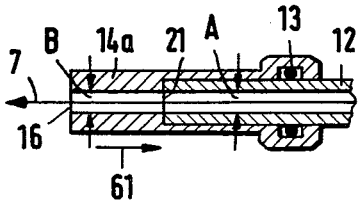
Figure 6:
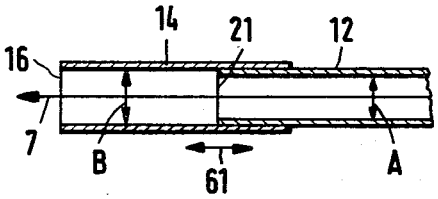
Figure 7:
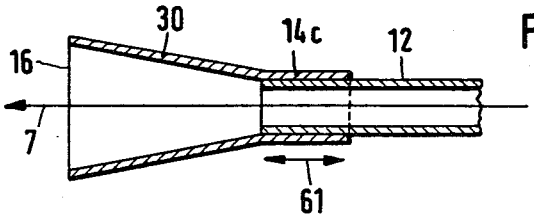

FIG. 1B diagramatically illustrates a velocity diagram of the relationships between the outflow channel and guide channel of the assembly of FIG. 1;

FIG. 2 illustrates a modified guide channel in accordance with the invention;

FIG. 3 illustrates a further modified guide channel having perforations in accordance with the invention;

FIG. 4 illustrates a cross-sectional view of a further modified nozzle assembly according to the invention;

FIG. 5 illustrates a partial cross-sectional view of a modified nozzle assembly according to the invention having a guide channel with a cross-sectional area equal to the cross-sectional area of an outflow channel of the insertion nozzle;

FIG. 6 illustrates a modified nozzle assembly having a guide channel telescoped onto an outflow channel in accordance with the invention; and FIG. 7 illustrates a conically tapered guide channel in accordance with the invention on a nozzle.

Referring to FIG. 1, the weft yarn insertion nozzle assembly is disposed at one side of the weaving machine (not shown). As indicated, the nozzle assembly is adapted to insert or pick a weft yarn 7 coming from a weft thread supply bobbin (not shown) into a shed 20 formed by a multiplicity of warp yarns 22 for forming a fabric 23.

The nozzle assembly includes a housing 1 in which two successive nozzles 2, 3 are formed. As shown, each nozzle 2, 3 contains a nozzle body 4 which is inserted into a bore 6 of the housing 1. Each body 4 includes suitable annular grooves in which annular seals 5, such as rubber rings are mounted for sealing against the bore 6. Each nozzle body 4 contains a passage 8 through which the weft yarn 7 is directed in a picking direction towards the shed 20. This passage is circumferentially surrounded by a plurality of air admission channels 9 which are fed with air from air feed ducts 11 in the housing via a reduced peripheral section of the body 4. The passage 8 and channels 9 merge into a passage of predetermined cross-sectional area A which is formed in an outflow channel or tube 12 extending from the body 4 towards the following nozzle 3 or shed 20.

In addition, the nozzle assembly has a guide channel in the form of a tube 14 following the outflow channel or tube 12 which is movable in the picking direction. As shown, the tube 14 includes an annular recess at one end which receives a seal ring 13, for example a rubber ring, for sealing against the outer periphery of the outflow tube 12. The guide tube 14 is mounted for a linear back-and-forth motion as indicated by the arrow 61. In addition, each guide tube 14 defines a passage with a cross-sectional area B greater than the cross-sectional area A of the outflow tube passage, for example from 4 to 8 times greater. Each guide tube 14 has an outlet 16 at the free end which is directed towards the following nozzle 3 or the shed 20, respectively.

As shown, the guide tube 14 of the nozzle 2 can be displaced to the left, as viewed, to the extent that a small gap C of, for example 1 to 2 millimeters, exists between the outlet end 16 and an inlet opening 17 of the following nozzle 3. Depending upon the operation of the weaving machine, this gap C can be adjusted by movement of the guide tube 14. For example, as viewed in FIG. 1*a*, the guide tube 14*d* can be abutted against the body 4 of the following nozzle 3 so that the guide tube 14*d* protrudes into the inlet opening 17 to abut against an inflow funnel 24 of the body 4. In this case, little or no air can issue into the surrounding environment.

Referring to FIG. 1*b*, the velocity of the air leaving the nozzle 2 at the outlet opening 21 of the outflow tube 12 is greatly reduced by the enlargement of the flow cross-section from A to B. Thus, a relatively large middle region M can be formed across the cross-section B in which there is practically constant velocity. By comparison, the velocity in the peripheral regions are negligibly small. This has a stabilizing effect on the passage of the yarn as the yarn has an increased tendency to remain in the central region. It is to be noted that a part of the air can issue into the surrounding environment via the gap C (see FIG. 1) while the remaining portion passes into the inflow opening 17 of the following nozzle 3.

In a corresponding manner, the guide tube 14 of the nozzle 3 can be brought relatively close to the shed 20 through which the warp yarns 22 pass in the direction indicated by the arrow 62.

Referring to FIG. 2, each guide tube 14 can be provided with two rows of perforations 27 at the free end 26. These perforations 27 allow a part of the air to pass into the surrounding environment, particularly in the case where the tube 14 protrudes into the inlet opening 17 of the nozzle 3 or abuts against the inflow funnel 24. In addition, as shown, the guide tube 14 can be threaded onto the outflow tube 12 via threads 28 such that the guide tube 14 is rotatably adjustable with respect to the outflow tube 12.

Referring to FIG. 3, the guide tube 14 may also be provided with a plurality of perforations over the full length. In this way, the amount of air issuing into the surrounding environment through the tube 14 can be adjusted by moving the tube 14 along the outflow tube 12.

Referring to FIG. 4, wherein like reference characters indicate like parts as above, the nozzle assembly may have the guide tube 14*a* mounted independently of the outflow tube 12 of the respective nozzles 2, 3. To this end, the guide tube 14*a* is mounted on a holder 31 which, in turn, is slidably received in a guide 42 for movement in the direction indicated by the arrow 45. In this case, the guide tube 14*a* is movable between a position over the outflow tube 12, as shown in dotted line, and a position spaced from the outflow tube 12 as indicated in solid line. As above, the guide tube 14*a* defines a passage having a cross-sectional area F substantially greater than the cross-sectional area A of the passage in the outflow tube 12. In this way, a relatively large central flow region of practically constant velocity develops within the tube 14*a* during operation.

Optionally, the nozzles 2, 3 can be displacably and adjustably mounted relative to each other via guides 41, 43 disposed in the housing 1. Thus, the nozzles 2, 3 can be moved in the directions indicated by the arrows 44, 46, respectively, relative to the guide tube 14A.

When the guide tube 14*a* is disposed over the outflow tube 12, a small annular clearance 34 can be provided. This clearance 34 allows a certain amount of air to issue into the surrounding environment as well as into the guide tube 14*a*.

It is to be noted that in the various embodiments, the relationship with respect to the conduction of the weft yarn 7 between the nozzles 2, 3 and the air entraining the weft yarn 7 can be varied in several respects. In particular, the guide tube 14, 14*a* can be adjusted between the two nozzles 2, 3 to optimum conditions by the operating personnel, for example during weaving.

In one modified embodiment, the nozzle 2 with the related outflow tube 12 and guide tube 14 can be eliminated so that only the nozzle 3 with the respective tubes 12, 14 remain. In this arrangement, the guide tube 14 which remains is displacable more or less in the direction of the shed 20.

Referring to FIG. 5, wherein like reference characters indicate like parts as above, the guide tube 14*a* can be shaped such that the cross-sectional area of the flow passage is equal to the cross-sectional flow area A of the outflow tube 12. Alternatively, several guide tubes 14*a* of different lengths, to be selectively pushed over the outflow tube 12, may be provided for one or both nozzles 2, 3.

Referring to FIG. 6, wherein like reference characters indicate like parts as above, the guide tube 14 may have a passage with a cross-sectional area B slightly greater than the cross-sectional area A of the passage of the outflow tube 12. In this case, there is practically no velocity difference occurring at the transition point 21 between the tubes 12, 14. In this case, the guide tube 14 effects a prolongation of the outflow tube 12 for the air issuing from the nozzle and for the entrained weft yarn 7. Thus, the quantity of air issuing into the surrounding environment can be regulated so as to reduce any tendency of the weft yarn 7 to be deflected. Alternatively, an additional extensible tube may be disposed on the guide tube 14 in a telescoping arrangement. In such a case, the telescoping arrangement may consist of three tubes.

Finally, referring to FIG. 7, wherein like reference characters indicate like parts as above, the guide tube 14*c* may have a free end 30 which is conically tapered in an outwardly diverging manner from the outflow tube 12. Such an enlarged free end 30 can act on the air jet in the manner of a Laval nozzle. Alternatively, several guide tubes 14*c* having different conical ends 30 can be selectively mounted on the outflow tube 12.

What is claimed is:

1. A yarn insertion nozzle assembly for a weaving machine, said assembly comprising at least one insertion nozzle having a passage for a yarn, a plurality of air admission channels merging with said passage into an outflow channel for passage of a yarn and a transporting stream therethrough and therefrom in a given flow direction; and a guide channel following said outflow channel, said guide channel being a tube adjustably mounted for movement in said flow direction to guide a yarn therethrough.

2. A yarn insertion nozzle assembly as set forth in claim 1 wherein said tube has a plurality of perforations therein at a free end thereof.

3. A yarn insertion nozzle assembly as set forth in claim 1 which further comprises a seal between said guide channel and said outflow channel.

4. A yarn insertion nozzle assembly as set forth in claim 1 wherein said guide channel is threaded into said outflow channel.

5. A yarn insertion nozzle assembly as set forth in claim 1 wherein said guide channel has a cross-sectional area substantially greater than the cross-sectional area of said outflow channel.

6. A yarn insertion nozzle assembly as set forth in claim 1 wherein said guide channel is conically tapered at a free end.

7. A weft insertion nozzle assembly for a weaving machine, said assembly comprising at least one weft insertion nozzle having an outflow tube having a passage of predetermined cross-sectional area for passage of a weft yarn together with a transporting stream therethrough and therefrom in a given direction towards a shed;

at least one guide tube downstream of said outflow tube, said guide tube being adjustably movable in said direction to guide a yarn therethrough;

a holder having said guide tube mounted thereon; and a guide slidably receiving said holder for moving said guide tube between a position over said outflow tube and a position spaced from said outflow tube.

8. A weft insertion nozzle assembly as set forth in claim 7 wherein said guide tube is slidably mounted on said outflow tube.

9. A weft insertion nozzle assembly as set forth in claim 7 wherein said tube defines a passage with a cross-sectional area greater than said cross-sectional area of said outflow tube passage.

10. A weft insertion nozzle assembly as set forth in claim 9 wherein said cross-sectional area of said passage of said guide tube is four to eight times larger than said cross-sectional area of said outflow tube passage.

11. A weft insertion nozzle assembly as set forth in claim 7 wherein said guide tube is perforated.

12. A weft insertion nozzle assembly as set forth in claim 7 wherein said guide tube defines a passage with a cross-sectional area equal to said cross-sectional area of said outflow tube passage.

13. A weft insertion nozzle assembly as set forth in claim 7 wherein said guide tube has a free end conically tapered in an outwardly diverging manner from said outflow tube.

14. In combination with a weaving machine having means for forming a shed of warp yarns, a weft insertion nozzle assembly comprising at least one weft insertion nozzle having a passage for a yarn, a plurality of air admission channels merging with said passage into an outflow channel for passage of a weft yarn together with a transporting stream therethrough and therefrom towards the shed and at least one guide tube coaxially disposed downstream of said outflow channel, said tube being movable coaxially relative to said guide channel to guide the weft yarn towards said shed.

* * * * *